US012496497B2

(12) United States Patent
Kuntimaddi et al.

(10) Patent No.: US 12,496,497 B2
(45) Date of Patent: Dec. 16, 2025

(54) GOLF BALL INCLUDING METAL FOAM LAYER

(71) Applicant: Acushnet Company, Fairhaven, MA (US)

(72) Inventors: Manjari Kuntimaddi, Raynham, MA (US); Edward Costa, East Providence, RI (US); Erin C. McDermott, Providence, RI (US)

(73) Assignee: Acushnet Company, Fairhaven, MA (US)

( * ) Notice: Subject to any disclaimer, the term of this patent is extended or adjusted under 35 U.S.C. 154(b) by 41 days.

(21) Appl. No.: 18/509,513

(22) Filed: Nov. 15, 2023

(65) Prior Publication Data

US 2025/0153007 A1 May 15, 2025

(51) Int. Cl.
*A63B 37/06* (2006.01)
*A63B 37/00* (2006.01)

(52) U.S. Cl.
CPC ..... *A63B 37/0039* (2013.01); *A63B 37/0044* (2013.01); *A63B 37/0045* (2013.01); *A63B 37/0047* (2013.01)

(58) Field of Classification Search
CPC ..... A63B 37/0039; A63B 37/0051; A63B 37/0047; A63B 37/0066
See application file for complete search history.

(56) References Cited

U.S. PATENT DOCUMENTS 4,229,401 A 10/1980 Pocklington
5,849,237 A * 12/1998 Inoue ..... B29C 45/14073 425/444
6,142,887 A 11/2000 Sullivan et al.
6,270,429 B1 8/2001 Sullivan
6,566,483 B2 5/2003 Cho et al.
6,653,382 B1 11/2003 Statz et al.
6,677,401 B2 1/2004 Boehm et al.
6,695,718 B2 2/2004 Nesbitt
6,756,436 B2 6/2004 Rajagopalan et al.
6,774,187 B2 8/2004 Voorheis et al.
6,894,098 B2 5/2005 Rajagopalan et al.
6,919,393 B2 7/2005 Mano et al.
6,939,907 B2 9/2005 Rajagopalan et al.
6,953,820 B2 10/2005 Statz et al.
6,964,622 B1 11/2005 Dewanjee
6,982,301 B1 1/2006 Voorheis et al.
6,992,135 B2 1/2006 Boehm et al.
7,041,721 B2 5/2006 Rajagopalan et al.
7,138,460 B2 11/2006 Sullivan et al.
8,524,316 B1 9/2013 Tomita et al.
(Continued)

OTHER PUBLICATIONS

Website <https://ergaerospace.com/carbon-rvc-foam-open-cell-material/#:~:text=What%20is%20Carbon%20(RVC)%20foam,of%20material%20per%20unit%20volume>; "Carbon (RVC) Foam;" (Jan. 26, 2022) (6 pages).
(Continued)

*Primary Examiner* — Raeann Gorden
(74) *Attorney, Agent, or Firm* — Thomas P. Gushue

(57) ABSTRACT

A golf ball composition is disclosed herein that includes at least one layer formed from metal foam. The metal foam can provide lightweight, durable, and high strength design parameters for golf ball constructions in order to provide greater adaptability and customizability, among other advantages.

17 Claims, 2 Drawing Sheets

(56) References Cited

U.S. PATENT DOCUMENTS

| | | | | |
|---|---|---|---|---|
| 9,220,946 | B2 | 12/2015 | Sullivan et al. | |
| 9,656,127 | B2 | 5/2017 | Binette et al. | |
| 10,427,008 | B2 | 10/2019 | Sullivan et al. | |
| 11,344,771 | B2 | 5/2022 | Sullivan et al. | |
| 2007/0093318 | A1 | 4/2007 | Bartsh et al. | |
| 2008/0057332 | A1 | 3/2008 | Owens et al. | |
| 2008/0171616 | A1 | 7/2008 | DuFaux et al. | |
| 2008/0207354 | A1 | 8/2008 | DuFaux et al. | |
| 2010/0075776 | A1* | 3/2010 | Nardacci ..... | A63B 37/0096 473/371 |
| 2016/0332036 | A1* | 11/2016 | Molinari ..... | A63B 37/004 |
| 2017/0333758 | A1 | 11/2017 | DuFaux et al. | |
| 2018/0078825 | A1 | 3/2018 | DuFaux et al. | |
| 2022/0362636 | A1 | 11/2022 | Park | |

OTHER PUBLICATIONS

Website <https://www.sciencedirect.com/topics/chemical-engineering/metal-foam>; "Science Direct—Metal Foam;" (2019) (14 pages).

Jerz et. al.; "New Concept For Design of Lightweight Automotive Components;" European Automotive Congress (Jun. 2001) (6 pages).

Jiang et. al.; "Ultralight metal foams;" Scientific Reports; (Sep. 8, 2015) (8 pages).

Website <https://www.americanelements.com/foams.html#:~:text=A%20metallic%20foam%20or%20ceramic,(open%2Dcell%20foam)>; "American Elements—Metallic & Ceramic Foams;" (Nov. 29, 2022) (7 pages).

Parveez et. al.; "Microstructure and Mechanical Properties of Metal Foams Fabricated via Melt Foaming and Powder Metallurgy Technique: A Review;" (Aug. 1, 2022) (27 pages).

Kalpakoglou et. al.; "Metal foams: A review for mechanical properties under tensile and shear stress;" (Oct. 27, 2022) (18 pages).

Marx et. al.; "Performance of Composite Metal Foam Armors against Various Threat Sizes;" (Nov. 23, 2020) (41 Pages).

Grilec et. al.; "A Study On Energy Absorption of Aluminium Foam;" (2010) (4 pages).

Rabiei et. al.; "Recent Advances in the Analysis, Measurement, and Properties of Composite Metal Foams;" (Abstract Only) (Feb. 17, 2021) (10 pages).

* cited by examiner

GOLF BALL INCLUDING METAL FOAM LAYER

FIELD OF THE INVENTION

This disclosure generally is generally related to a golf ball, and is more particularly related to a golf ball having at least one layer comprised of metal foam.

BACKGROUND OF THE INVENTION

Various golf ball constructions and materials for forming golf balls are well known in the art. Golf balls typically include a core formed from a rubber composition and a urethane or ionomer cover, with at least one additional layer (i.e., casing or mantle layer) optionally arranged therebetween. The additional layer between the core and cover can be formed from ionomer, in some exemplary constructions.

It would be desirable to provide improved, high performance materials for at least one layer or component of a golf ball in order to provide greater design variability, such as enhanced strength-to-weight ratios, mass reduction, durability, etc.

SUMMARY OF THE INVENTION

Various golf ball configurations are disclosed herein that include a metal foam, and more specifically a metal foam in at least one or more layers of the golf ball.

In one aspect, a golf ball is provided that includes at least one first layer comprised of at least one metal foam. The metal foam can have a specific gravity of no greater than 0.25, in one aspect. In another aspect, the specific gravity of the metal foam is no greater than 0.10. In another aspect, the specific gravity of the metal foam is no greater than 0.05. In yet another aspect, the specific gravity of the metal foam is no greater than 0.01. In yet another aspect, the specific gravity of the metal foam is no greater than 0.005.

In some examples, the metal foam can be formed from at least one of aluminum, copper, tantalum, tin, titanium, or zinc. One of ordinary skill in the art would understand that any metal could be foamed and implemented as a golf ball layer based on the present disclosure.

In one aspect, the metal foam can have a porosity of at least 50.0%. In another aspect, the metal foam can have a porosity of at least 75.0%. In yet another aspect, the metal foam can have a porosity of 70.0%-99.9%. In yet another aspect, the metal foam can have a porosity of at least 95.0%.

Various constructions for the golf ball having at least one layer or component formed from metal foam are disclosed herein. In one aspect, the golf ball can be comprised of a core, an intermediate layer, and a cover, and the at least one layer comprised of the metal foam can be the intermediate layer. In another aspect, the golf ball is comprised of a core, an intermediate layer, and a cover, and the at least one layer comprised of the metal foam can be the core. In another aspect, the golf ball is comprised of an inner core, an outer core, an intermediate layer, and a cover, and the at least one layer comprised of the metal foam can be the inner core. In yet another aspect, the golf ball is comprised of an inner core, an outer core, an intermediate layer, and a cover, and the at least one layer comprised of the metal foam can be the outer core.

In one aspect, the core lacks any rubber and is formed entirely of metal foam. In another aspect, the intermediate layer or casing layer lacks any ionomer and is formed entirely of metal foam.

The at least one layer comprised of the metal foam can have an outer diameter of 0.25 inches-1.60 inches. The at least one layer comprised of the metal foam can have an outer diameter of 0.25 inches-1.62 inches. The at least one layer comprised of the metal foam can have an outer diameter of no greater than 1.62 inches. The at least one layer comprised of the metal foam can have an outer diameter of at least 0.75 inches. One of ordinary skill in the art would understand based on this disclosure that the diameter of the layer including the metal foam can vary, particularly depending on which layer or layers are formed from the metal foam.

The golf ball can further comprise at least one second layer that is disposed radially outward from the at least one first layer comprised of the metal foam, and the at least one second layer can have a second specific gravity (SG2), and wherein: $0.001 \leq (SG1/SG2) \leq 0.05$. The relationship or ratio between the first and second specific gravities can vary. In one aspect, $0.05 \leq (SG1/SG2) \leq 0.30$. In one aspect, the second specific gravity is 50-150 times greater than the first specific gravity.

As used in this disclosure, the term second layer can refer to a layer of the golf ball that is directly adjacent to the first layer or is separated from the first layer by at least one intermediate layer. In one aspect, the second layer can be radially inward or radially outward relative to the first layer.

The at least one first layer can have a hardness gradient defined between a center and a radially outer surface, and the hardness gradient can be less than 0.1. The hardness gradient can be zero, in one aspect.

In one aspect, the golf ball further comprises at least one second layer that is disposed radially outward from the at least one first layer (including the metal foam), and the at least one second layer has a second specific gravity (SG2). A density layer gradient ratio (DLGR) is defined by a ratio of the first specific gravity (SG1) to the second specific gravity (SG2), and the density layer gradient ratio (DLGR) is no greater than 0.050. In another aspect, the density layer gradient ratio (DLGR) is no greater than 0.025. In another aspect, the density layer gradient ratio (DLGR) is no greater than 0.010. In another aspect, the density layer gradient ratio (DLGR) is no greater than 0.005. In another aspect, the density layer gradient ratio (DLGR) is no greater than 0.001. In another aspect, the density layer gradient ratio (DLGR) is no greater than 0.30. In another aspect, the density layer gradient ratio (DLGR) is no greater than 0.50.

In one aspect, the at least one first layer is formed from a material having a first tensile strength (TS1), and the at least one second layer is formed from a material having a second tensile strength (TS2), such that the golf ball has a strength gradient ratio (SGR) defined by a ratio of the first tensile strength (TS1) to the second tensile strength (TS2), and the strength gradient ratio (SGR) is at least 2.0. In another aspect, the strength gradient ratio (SGR) is at least 5.0. In another aspect, the strength gradient ratio (SGR) is at least 7.5. In another aspect, the strength gradient ratio (SGR) is at least 10.0. In another aspect, the strength gradient ratio (SGR) is at least 20.0.

In one aspect, a ratio of the strength gradient ratio (SGR) to the density layer gradient ratio (DLGR) is at least 100. In another aspect, a ratio of the strength gradient ratio (SGR) to the density layer gradient ratio (DLGR) is at least 250. In one aspect, a ratio of the strength gradient ratio (SGR) to the density layer gradient ratio (DLGR) is at least 1,000. In one aspect, a ratio of the strength gradient ratio (SGR) to the density layer gradient ratio (DLGR) is at least 2,000.

In another aspect, a golf ball is provided that includes a core comprised of at least one metal foam. The at least one metal foam is comprised of at least one of aluminum, copper, tantalum, tin, titanium, or zinc. One of ordinary skill in the art would appreciate that any known metals can be used. The golf ball can further comprise at least one layer disposed radially outward from the core. The core can have a first specific gravity (SG1) and the at least one layer can have a second specific gravity (SG2), and the first specific gravity (SG1) can be no greater than 10% of the second specific gravity (SG2). In one aspect, the first specific gravity (SG1) is no greater than 5% of the second specific gravity (SG2). In one aspect, the first specific gravity (SG1) is no greater than 1% of the second specific gravity (SG2).

Various other features and aspects of a golf ball including a metal foam layer or component are disclosed herein.

BRIEF DESCRIPTION OF THE DRAWINGS

Further features and advantages of the present disclosure can be ascertained from the following detailed description that is provided in connection with the drawings described below.

DETAILED DESCRIPTION OF THE INVENTION

Figure 1A:
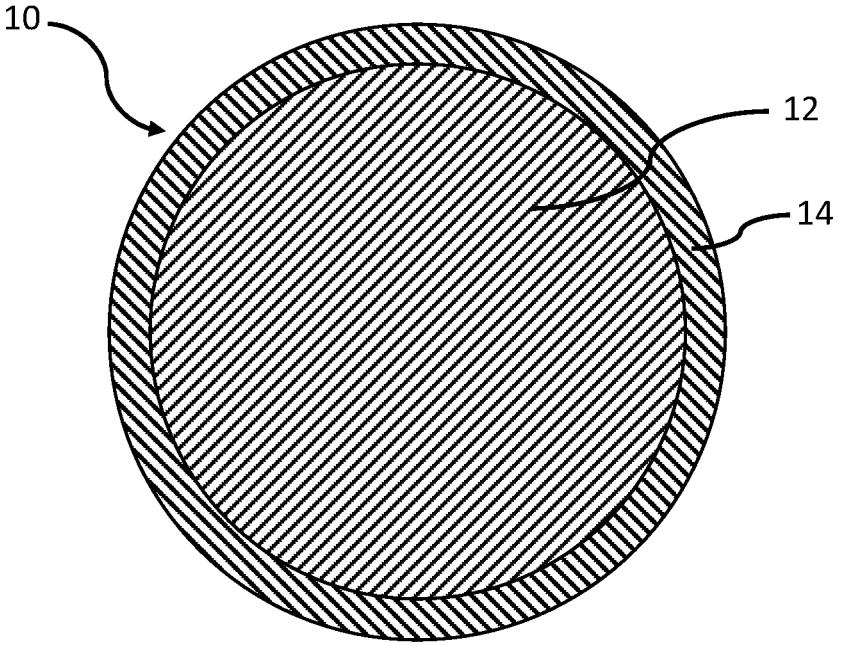
FIG. 1A is a cross-sectional view of a two-piece golf ball in accordance with one example.

As disclosed herein, various configurations, formulations, and compositions are disclosed for a golf ball. Various construction or compositions of golf ball layers are provided herein. Any one or more of the golf ball layers can be formed from a metal foam instead of the various alternative materials described herein.

Core Formulations

Concentrations of components are in parts per hundred (phr) unless otherwise indicated. As used herein, the term, "parts per hundred," also known as "phr" or "pph" is defined as the number of parts by weight of a particular component present in a mixture, relative to 100 parts by weight of the polymer component or overall component composition. Mathematically, this can be expressed as the weight of an ingredient divided by the total weight of the polymer or component composition, multiplied by a factor of 100.

Base Rubber

In one aspect, the core rubber formulations of the present disclosure can include a base rubber. In some embodiments, the base rubber may include natural and synthetic rubbers and combinations of two or more thereof. In some embodiments, the core rubber formulations of the core can further include a metal foam or metal foam additive.

Examples of natural and synthetic rubbers suitable for use as the base rubber include, but are not limited to, polybutadiene, polyisoprene, ethylene propylene rubber (EPR), ethylene-propylene-diene (EPDM) rubber, grafted EPDM rubber, styrene-butadiene rubber, styrenic block copolymer rubbers (such as "SI", "SIS", "SB", "SBS", "SIBS", and the like, where "S" is styrene, "I" is isobutylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof.

For example, the core may be formed from a rubber formulation that includes polybutadiene as the base rubber. Polybutadiene is a homopolymer of 1,3-butadiene. The double bonds in the 1,3-butadiene monomer are attacked by catalysts to grow the polymer chain and form a polybutadiene polymer having a desired molecular weight. Any suitable catalyst may be used to synthesize the polybutadiene rubber depending upon the desired properties. In one embodiment, a transition metal complex (for example, neodymium, nickel, or cobalt) or an alkyl metal such as alkyl lithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis-bond and trans-bond structures. For example, the polybutadiene rubber may have a 1,4 cis-bond content of at least 40 percent. In another embodiment, the polybutadiene rubber has a 1,4 cis-bond content of greater than 80 percent. In still another embodiment, the polybutadiene rubber has a 1,4 cis-bond content of greater than 90 percent. In general, polybutadiene rubbers having a high 1,4 cis-bond content have high tensile strength and rebound.

The polybutadiene rubber may have a relatively high or low Mooney viscosity. Generally, polybutadiene rubbers of higher molecular weight and higher Mooney viscosity have better resiliency than polybutadiene rubbers of lower molecular weight and lower Mooney viscosity. However, as the Mooney viscosity increases, the milling and processing of the polybutadiene rubber generally becomes more difficult. Blends of high and low Mooney viscosity polybutadiene rubbers may be prepared as is described in U.S. Pat. Nos. 6,982,301 and 6,774,187, the disclosures of which are hereby incorporated by reference, and used in accordance with the present disclosure. In general, the lower limit of Mooney viscosity may be about 30 or 35 or 40 or 45 or 50 or 55 or 60 or 70 or 75 and the upper limit may be about 80 or 85 or 90 or 95 or 100 or 105 or 110 or 115 or 120 or 125 or 130. For example, the polybutadiene used in the rubber formulation may have a Mooney viscosity of about 30 to about 80 or about 40 to about 60.

Examples of commercially available polybutadiene rubbers that can be used in rubber formulations in accordance with the present disclosure, include, but are not limited to, BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp. of Pittsburgh. Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

In another embodiment, the core is formed from a rubber formulation including butyl rubber. Butyl rubber is an elastomeric copolymer of isobutylene and isoprene. Butyl rubber is an amorphous, non-polar polymer with good oxidative and thermal stability, good permanent flexibility, and high moisture and gas resistance. Generally, butyl rubber includes copolymers of about 70 percent to about 99.5 percent by weight of an isoolefin, which has about 4 to 7 carbon atoms, for example, isobutylene, and about 0.5 percent to about 30 percent by weight of a conjugated multiolefin, which has about 4 to 14 carbon atoms, for example, isoprene. The resulting copolymer contains about 85 percent to about 99.8 percent by weight of combined isoolefin and about 0.2 percent to about 15 percent of combined multiolefin. A commercially available butyl rubber suitable for use in rubber formulations in accordance with the present disclosure includes Bayer Butyl 301 manufactured by Bayer AG.

The rubber formulations may include a combination of two or more of the above-described rubbers as the base rubber. In some embodiments, the rubber formulation of the present disclosure includes a blend of different polybutadiene rubbers. In this embodiment, the rubber formulation may include a blend of a first polybutadiene rubber and a second polybutadiene rubber in a ratio of about 5:95 to about 95:5. For example, the rubber formulation may include a first polybutadiene rubber and a second polybutadiene rubber in a ratio of about 10:90 to about 90:10 or about 15:85 to about 85:15 or about 20:80 to about 80:20 or about 30:70 to about 70:30 or about 40:60 to about 60:40. In other embodiments, the rubber formulation may include a blend of more than two polybutadiene rubbers or a blend of polybutadiene rubber(s) with any of the other elastomers discussed above. In these formulations, the rubber formulation can be modified to include the first polybutadiene rubber, the second polybutadiene rubber, such that a combination of the first and second polybutadiene rubbers (in equal parts or any combination or ratio of first polybutadiene rubber to second polybutadiene rubber ranging from 99:1 to 1:99).

In other embodiments, the rubber formulation used to form the core can include a blend of polybutadiene and butyl rubber. In this embodiment, the rubber formulation may include a blend of polybutadiene and butyl rubber in a ratio of about 10:90 to about 90:10. For example, the rubber formulation may include a blend of polybutadiene and butyl rubber in a ratio of about 10:90 to about 90:10 or about 20:80 to about 80:20 or about 30:70 to about 70:30 or about 40:60 to about 60:40. In other embodiments, the rubber formulation may include polybutadiene and/or butyl rubber in a blend with any of the other elastomers discussed above.

In further embodiments, the rubber formulation used to form the core can include a blend of polybutadiene and EPDM rubber or grafted EPDM rubber as the base rubber. In still further embodiments, the rubber formulations may include a combination of polybutadiene rubber and EPDM rubber as the base rubber. In this embodiment, the EPDM may be included in the rubber formulation in an amount of about 0.1 to about 20 or about 1 to about 15 or about 3 to about 10 parts by weight per 100 parts of the total rubber. For example, EPDM may be included in the rubber formulation in an amount of about 5 parts by weight per 100 parts of the total rubber. In still further embodiments, the core formulations may combine EPDM rubber and two or more different types of polybutadiene rubber, such as two or more different types of high cis-1,4 polybutadiene, as the base rubber.

The rubber formulations include the base rubber in an amount of 100 phr. That is, when more than one rubber component is used in the rubber formulation as the base rubber, the sum of the amounts of each rubber component should total 100 phr. In some embodiments, the rubber formulations include polybutadiene rubber as the base rubber in an amount of 100 phr. In other embodiments, the rubber formulations include polybutadiene rubber and a second rubber component. In this embodiment, the polybutadiene rubber may be used in an amount of about 80 to about 99.9 parts by weight per 100 parts of the total rubber and the second rubber component may be used in an amount of about 0.1 to about 20 parts by weight per 100 parts of the total rubber.

In further embodiments, the polybutadiene rubber may be used in an amount of about 85 to about 99 parts by weight per 100 parts of the total rubber and the second rubber component may be used in an amount of about 1 to about 15 parts by weight per 100 parts of the total rubber.

In yet other embodiments, the polybutadiene rubber may be used in an amount of about 90 to about 97 parts by weight per 100 parts of the total rubber and the second rubber component may be used in an amount of about 3 to about 10 parts by weight per 100 parts of the total rubber.

In still further embodiments, the polybutadiene rubber may be used in an amount of about 94 to about 96 parts by weight per 100 parts of the total rubber and the second rubber component may be used in an amount of about 4 to about 6 parts by weight per 100 parts of the total rubber.

The base rubber may be used in the rubber formulation in an amount of at least about 5 percent by weight based on total weight of the rubber formulation. In some embodiments, the base rubber is included in the rubber formulation in an amount within a range having a lower limit of about 10 percent or 20 percent or 30 percent or 40 percent or 50 percent or 55 percent and an upper limit of about 60 percent or 70 percent or 80 percent or 90 percent or 95 percent or 100 percent. For example, the base rubber may be present in the rubber formulation in an amount of about 30 percent to about 80 percent by weight based on the total weight of the rubber formulation. In another example, the rubber formulation includes about 40 percent to about 70 percent base rubber based on the total weight of the rubber formulation.

In yet another example, the core can be formed from a metal foam. In one aspect, the metal foam can form the entirety of the core. In one aspect, the core lacks any rubber, and instead is formed entirely from metal foam. In one aspect, the core is a multi-layer core, and at least one layer of the core is formed from metal foam. Other layers of the multi-layer core can be formed from rubber. In one aspect, the core can be formed from a mixture of metal foam and rubber.

Crosslinking Co-Agent

The rubber formulations can further include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. In one embodiment, the co-agent is one or more metal salts of acrylates, diacrylates, methacrylates, and dimethacrylates, wherein the metal is selected from magnesium, calcium, zinc, aluminum, lithium, and nickel. In another embodiment, the co-agent includes one or more zinc salts of acrylates, diacrylates, methacrylates, and dimethacrylates. For example, the co-agent may be zinc diacrylate (ZDA). In another embodiment, the co-agent may be zinc dimethacrylate (ZDMA). An example of a commercially available zinc diacrylate includes Dymalink® 526 manufactured by Cray Valley.

The co-agent may be included in the rubber formulation in varying amounts depending on the desired characteristics of the golf ball core. For example, the co-agent may be used in an amount of about 5 to about 50 or about 10 to about 45 or about 15 to about 40 parts by weight per 100 parts of the total rubber. In one embodiment, the rubber formulation of the core includes about 35 to about 48 parts by weight co-agent per 100 parts of the total rubber. In another embodiment, the rubber formulation includes about 38 to about 45 or about 39 to about 42 parts by weight co-agent per 100 parts of total rubber. In another embodiment, the co-agent is included in the rubber formulation of the core in an amount of about 29 to about 37 or about 31 to about 35 parts by weight per 100 parts of the total rubber. In still another embodiment, the rubber formulation includes about 25 to about 33 or about 27 to about 31 parts by weight co-agent per 100 parts of the total rubber. In yet another example, the co-agent may be used in an amount of about 20-40 parts by weight per 100 parts of the total rubber. In one example, the co-agent is used in an amount of about 30-35 parts by weight per 100 parts of the total rubber. In one example, the co-agent is used in an amount of about 32-33 parts by weight per 100 parts of the total rubber.

Free Radical Initiator

The core formulations may include a free radical initiator selected from an organic peroxide, a high energy radiation source capable of generating free radicals, or a combination thereof. Suitable organic peroxides include, but are not limited to, dicumyl peroxide; n-butyl-4,4-di(t-butylperoxy) valerate; 1,1-di(t-butylperoxy) 3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy) hexyne-3; di(2-t-butyl-peroxyisopropyl) benzene; dilauroyl peroxide; dibenzoyl peroxide; t-butyl hydroperoxide; and combinations thereof. In a particular embodiment, the free radical initiator is dicumyl peroxide, including, but not limited to Perkadox® BD-FF, commercially available from Akzo Nobel. In other embodiments, the free radical initiator is dimethyl terbutyl peroxide, including, but not limited to Trigonox® 101-50D-PD, commercially available from Nouryon.

Free radical initiators may be present in the rubber formulation in an amount of at least 0.05 parts by weight per 100 parts of the total rubber, or an amount within the range having a lower limit of 0.05 parts or 0.1 parts or 1 part or 1.25 parts or 1.5 parts or 2.5 parts or 5 parts by weight per 100 parts of the total rubber, and an upper limit of 2.5 parts or 3 parts or 5 parts or 6 parts or 10 parts or 15 parts by weight per 100 parts of the total rubber. For example, the rubber formulation may include peroxide free radical initiators in an amount of about 0.1 to about 10 or about 0.5 to about 6 or about 1 to about 5 parts by weight per 100 parts of the total rubber. In another example, the rubber formulation may include peroxide free radical initiators in an amount of about 0.5 to about 2 or about 0.7 to about 1.8 or about 0.8 to about 1.2 or about 1.3 to about 1.7 parts by weight per 100 parts of the total rubber. In yet another example, the rubber formulation may include peroxide free radical initiators in an amount of about 1.5 to about 3 or about 1.7 to about 2.8 or about 1.8 to about 2.2 or about 2.3 to about 2.7 parts by weight per 100 parts of the total rubber.

Additives

Radical scavengers such as a halogenated organosulfur, organic disulfide, or inorganic disulfide compounds may also be added to the rubber formulation. In one embodiment, a halogenated organosulfur compound included in the rubber formulation includes, but is not limited to, pentachlorothiophenol (PCTP) and salts of PCTP such as zinc pentachlorothiophenol (ZnPCTP). In another embodiment, ditolyl disulfide, diphenyl disulfide, dixylyl disulfide, 2-nitroresorcinol, and combinations thereof are added to the rubber formulation. An example of a commercially available radical scavenger includes Rhenogran® Zn-PTCP-72 manufactured by Rheine Chemie. The radical scavenger may be included in the rubber formulation in an amount of about 0.3 to about 1.0 part by weight per 100 parts of the total rubber. In one embodiment, the rubber formulation may include about 0.4 to about 0.9 parts by weight radical scavenger per 100 parts of the total rubber. In another embodiment, the rubber formulation may include about 0.5 to about 0.8 parts by weight radical scavenger per 100 parts of the total rubber. In another embodiment, the rubber formulation may include about 0.3 parts to about 0.4 parts by weight radical scavenger per 100 parts of the total rubber. In yet another embodiment, the rubber formulation may include about 0.1 parts to about 0.3 parts by weight radical scavenger per 100 parts of the total rubber.

Fillers

In one aspect, the present disclosure is directed to a golf ball core that only includes carbon black, clay and nanoclay particles, talc, glass (e.g., glass flake, milled glass, and microglass), mica and mica-based pigments (e.g., Iriodin® pearl luster pigments from The Merck Group), and combinations thereof. Metal oxide and metal sulfate fillers are also contemplated for inclusion in the rubber formulation. Suitable metal fillers include, for example, particulate, powders, flakes, pastilles, and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof. Suitable metal oxide fillers include, for example, zinc oxide, iron oxide, aluminum oxide, titanium oxide, magnesium oxide, and zirconium oxide. Suitable metal sulfate fillers can include, for example, barium sulfate and/or strontium sulfate. An example of a commercially available barium sulfate filler includes PolyWate® 325 manufactured by Cimbar Performance Minerals. When included, the fillers may be in an amount of about 1 to about 25 parts by weight per 100 parts of the total rubber. In one embodiment, the rubber formulation includes at least one filler in an amount of about 5 to about 20 or about 8 to about 15 parts by weight per 100 parts of the total rubber. In another embodiment, the rubber formulation includes at least one filler in an amount of about 8 to about 14 or about 10 to about 12 parts by weight per 100 parts of the total rubber. In yet another embodiment, the rubber formulation includes at least one filler in an amount of about 10 to about 17 or about 12 to about 15 parts by weight per 100 parts of the total rubber. In yet another embodiment, the rubber formulation includes at least one filler in an amount of about 10 to about 16 or about 12 to about 15 parts by weight per 100 parts of the total rubber. In a further embodiment, the rubber formulation includes at least one filler in an amount of about 12 to about 18 or about 14 to about 16 parts by weight per 100 parts of the total rubber. In a further embodiment, the rubber formulation includes at least one filler in an amount of about 1 part to about 30 parts by weight per 100 parts of the total rubber. In one example, the filler is added to weight for a specific gravity, and the exact values can vary depending on the specific gravity of a specific rubber batch.

In some aspects, the amount of filler in the rubber formulation may be altered based on the compound, and the particular isomer of the compound, used as the hardening agent. For example, when the rubber formulation includes 2-nitrophenol, at least one filler may be included in the rubber formulation in amount from about 9 to about 13 parts by weight per 100 parts of the total rubber. In another example, when the rubber formulation includes 3-nitrophenol, the filler may be included in the rubber formulation in amount from about 11 to about 16 parts by weight per 100 parts of the total rubber. In yet another example, when the rubber formulation includes 4-nitrophenol, the filler may be included in the rubber formulation in amount from about 13 to about 17 parts by weight per 100 parts of the total rubber.

In some embodiments, more than one type of filler may be included in the rubber formulation. For example, the rubber formulation may include a first filler in an amount from about 5 to about 20 or about 8 to about 17 parts by weight per 100 parts total rubber and a second filler in an amount from about 1 to about 10 or about 3 to about 7 parts by weight per 100 parts total rubber. In another example, the rubber formulation may include a first filler in an amount from about 7 to about 13 or about 9 to about 12 parts by weight per 100 parts total rubber and a second filler in an amount from about 2 to about 8 or about 4 to about 6 parts by weight per 100 parts total rubber. In yet another example, the rubber formulation may include a first filler in an amount from about 10 to about 15 or about 13 to about 14 parts by weight per 100 parts total rubber and a second filler in an amount from about 2 to about 9 or about 3 to about 7 parts by weight per 100 parts total rubber. In a further example, the rubber formulation may include a first filler in an amount from about 10 to about 15 or about 13 to about 14 parts by weight per 100 parts total rubber and a second filler in an amount from about 13 to about 18 or about 14 to about 16 parts by weight per 100 parts total rubber.

Antioxidants, processing aids, accelerators (for example, tetra methylthiuram), dyes and pigments, wetting agents, surfactants, plasticizers, coloring agents, fluorescent agents, chemical blowing and foaming agents, defoaming agents, stabilizers, softening agents, impact modifiers, antiozonants, as well as other additives known in the art, may also be added to the rubber formulation. Examples of suitable processing aids include, but are not limited to, high molecular weight organic acids and salts thereof. Suitable organic acids are aliphatic organic acids, aromatic organic acids, saturated mono-functional organic acids, unsaturated mono-functional organic acids, multi-unsaturated mono-functional organic acids, and dimerized derivatives thereof. In one embodiment, the organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, and dimerized derivatives thereof. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoleic or dimerized derivatives thereof.

Curing the Core Formulation

The rubber, hardening agent, cross-linking agent, free radical initiator, fillers, and any other materials used in forming the core, in accordance with the present disclosure, may be combined to form a mixture by any type of mixing known to one of ordinary skill in the art. Suitable types of mixing include single pass and multi-pass mixing, and the like. A single pass mixing process where ingredients are added sequentially can be used because this type of mixing tends to increase efficiency and reduce costs for the process. In embodiments where a free-radical initiator is used, it may be desirable to combine the hardening agent into the rubber formulation prior to adding the free-radical initiator.

The rubber formulation may be cured using conventional curing processes. Non-limiting examples of curing processes suitable for use in accordance with the present disclosure include peroxide-curing, sulfur-curing, high-energy radiation, and combinations thereof.

The golf balls of the present disclosure may be formed using a variety of application techniques. For example, the golf ball, golf ball core, or any layer of the golf ball may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials. In this aspect, cover layers may be formed over the core using any suitable technique that is associated with the material used to form the layer. Preferably, each cover layer is separately formed over the core. For example, an ethylene acid copolymer ionomer composition may be injection-molded to produce half-shells over the core. Alternatively, the ionomer composition can be placed into a compression mold and molded under sufficient pressure, temperature, and time to produce the hemispherical shells, which may then be placed around the core in a compression mold. An outer cover layer including a polyurethane or polyurea composition over the ball sub-assembly may be formed by using a casting process.

The rubber formulations discussed above are suitable for use in the core or one or more of the core layers if multiple core layers are present. It is also contemplated that the rubber formulations disclosed herein may be used to form one or more of the layers of any of the one, two, three, four, or five, or more-piece (layered) balls described above. That is, any of the core layers, intermediate layers, and/or cover layers may comprise the rubber formulation of this disclosure. The rubber formulations of different layers may be the same or different.

Formation of Metal Foam Structure

One of ordinary skill in the art would understand that the metal foam used to form the core, intermediate layer, outer layer, or any other layer of the golf ball, can be formed according to various metal foam formation processes. For example, powder metallurgy, metal foaming, bubbling gas or gas dissolution, foaming agents, vapor and/or deposition techniques, sintering, and/or casting processes can be used for forming the metal foam. One of ordinary skill in the art would understand that various other formation techniques could be used for forming the metal foam.

In one aspect, powder metallurgy can be used to form metal foam used as a core layer. The blowing agent can be mixed with metallic powder and heated and formed in a furnace, similarly to the heated compression molding step of a traditional rubber core. This technique can also be used for the outer core layer, which can be molded atop an inner rubber core. Powder metallurgy can also be used if the foam were to be in a cast cover layer. Polyurethane can be foamed to provide an open-celled skeleton, and the metal foam can then be formed in these cells.

Vapor/deposition can be used in any layer. This technique can include making of a foam through any method (catalytic, two-part, etc.) and depositing metal over top. This technique could be used for an inner or outer core, casing, or cover layer. For example, a foam could be created for use as a cover layer, and a metal halide, or other suitable material, can deposit the metal atop and through the pores of the foam.

Open-cell or closed-cell metal foams can be created through sintering. A metal and salt powder can be mixed, compressed, and sintered to melt the metal. The salt is dissolved in water, and an open-cell foam can be produced. This process can be used for any layer of the golf ball.

Casting can be used for any layer of the golf ball. A pattern (whether designed or abstract) can be created through polystyrene foam, then the metal can be poured atop it, which burns away the polystyrene and leaves a metal foam.

Cover

In one aspect, different materials may be used in the construction of the intermediate and cover layers of golf balls according to the present disclosure. For example, a variety of materials may be used for forming the outer cover including, for example, polyurethanes; polyureas; copolymers, blends and hybrids of polyurethane and polyurea; olefin-based copolymer ionomer resins; polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly (amide-ester) elastomers, and graft copolymers of ionomer; cross-linked trans-polyisoprene and blends thereof; polyester-based thermoplastic elastomers; polyurethane-based thermoplastic elastomers; synthetic or natural vulcanized rubber; and combinations thereof. In another aspect, metal foam can be incorporated into the formation of the cover layer, as disclosed herein.

In one embodiment, the cover is formed from a polyurethane, polyurea, or hybrid of polyurethane-polyurea. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Conventional and non-conventional materials may be used for forming intermediate layers of the ball including, for instance, ionomer resins, highly neutralized polymers, polybutadiene, butyl rubber, and other rubber-based core formulations, and the like. In one embodiment, the inner cover layer, i.e., the layer disposed between the core and the outer cover, includes an ionomer. In this aspect, ionomers suitable for use in accordance with the present disclosure may include partially neutralized ionomers and highly neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70 percent of all acid groups present in the composition are neutralized.

Preferred ionomers are salts of O/X- and O/X/Y-type acid copolymers, wherein O is an α-olefin, X is a $C_3$-$C_8$ α, β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are particularly preferred. Y is preferably selected from (meth)acrylate and alkyl (meth) acrylates wherein the alkyl groups have from 1 to 8 carbon atoms, including, but not limited to, n-butyl (meth)acrylate, isobutyl (meth)acrylate, methyl (meth)acrylate, and ethyl (meth)acrylate.

Preferred O/X and O/X/Y-type copolymers include, without limitation, ethylene acid copolymers, such as ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl (meth)acrylate, ethylene/(meth)acrylic acid/iso-butyl (meth)acrylate, ethylene/(meth)acrylic acid/methyl (meth)acrylate, ethylene/(meth) acrylic acid/ethyl (meth)acrylate terpolymers, and the like. The term, "copolymer," as used herein, includes polymers having two types of monomers, those having three types of monomers, and those having more than three types of monomers. Preferred a, B-ethylenically unsaturated mono- or dicarboxylic acids are (meth)acrylic acid, ethacrylic acid, maleic acid, crotonic acid, fumaric acid, itaconic acid. (Meth) acrylic acid is most preferred. As used herein, "(meth)acrylic acid" means methacrylic acid and/or acrylic acid. Likewise, "(meth)acrylate" means methacrylate and/or acrylate.

In a particularly preferred version, highly neutralized E/X- and E/X/Y-type acid copolymers, wherein E is ethylene, X is a $C_3$-$C_8$ α, β-ethylenically unsaturated carboxylic acid, and Y is a softening monomer are used. X is preferably selected from methacrylic acid, acrylic acid, ethacrylic acid, crotonic acid, and itaconic acid. Methacrylic acid and acrylic acid are particularly preferred. Y is preferably an acrylate selected from alkyl acrylates and aryl acrylates and preferably selected from (meth)acrylate and alkyl (meth)acrylates wherein the alkyl groups have from 1 to 8 carbon atoms, including, but not limited to, n-butyl (meth)acrylate, isobutyl (meth)acrylate, methyl (meth)acrylate, and ethyl (meth)acrylate. Preferred E/X/Y-type copolymers are those wherein X is (meth)acrylic acid and/or Y is selected from (meth)acrylate, n-butyl (meth)acrylate, isobutyl (meth)acrylate, methyl (meth)acrylate, and ethyl (meth)acrylate. More preferred E/X/Y-type copolymers are ethylene/(meth)acrylic acid/n-butyl acrylate, ethylene/(meth)acrylic acid/methyl acrylate, and ethylene/(meth)acrylic acid/ethyl acrylate.

The amount of ethylene in the acid copolymer may be at least about 15 weight percent, at least about 25 weight percent, at least about 40 weight percent, or at least about 60 weight percent, based on total weight of the copolymer. The amount of $C_3$ to $C_8$ α, β-ethylenically unsaturated mono- or dicarboxylic acid in the acid copolymer is typically from 1 weight percent to 35 weight percent, from 5 weight percent to 30 weight percent, from 5 weight percent to 25 weight percent, or from 10 weight percent to 20 weight percent, based on total weight of the copolymer. The amount of optional softening comonomer in the acid copolymer may be from 0 weight percent to 50 weight percent, from 5 weight percent to 40 weight percent, from 10 weight percent to 35 weight percent, or from 20 weight percent to 30 weight percent, based on total weight of the copolymer.

The various O/X, E/X, O/X/Y, and E/X/Y-type copolymers are at least partially neutralized with a cation source, optionally in the presence of a high molecular weight organic acid, such as those disclosed in U.S. Pat. No. 6,756,436, the entire disclosure of which is hereby incorporated herein by reference. The acid copolymer can be reacted with the optional high molecular weight organic acid and the cation source simultaneously, or prior to the addition of the cation source. Suitable cation sources include, but are not limited to, metal ion sources, such as compounds of alkali metals, alkaline earth metals, transition metals, and rare earth elements; ammonium salts and monoamine salts; and combinations thereof. Preferred cation sources are compounds of magnesium, sodium, potassium, cesium, calcium, barium, manganese, copper, zinc, lead, tin, aluminum, nickel, chromium, lithium, and rare earth metals. The amount of cation used in the composition is readily determined based on desired level of neutralization. As discussed above, for HNP compositions, the acid groups are neutralized to 70 percent or greater, 70 to 100 percent, or 90 to 100 percent. In one embodiment, an excess amount of neutralizing agent, that is, an amount greater than the stoichiometric amount needed to neutralize the acid groups, may be used. That is, the acid groups may be neutralized to 100 percent or greater, for example 110 percent or 120 percent or greater. In other embodiments, partially neutralized compositions are prepared, wherein 10 percent or greater, normally 30 percent or greater of the acid groups are neutralized. When aluminum is used as the cation source, it is preferably used at low levels with another cation such as zinc, sodium, or lithium, since aluminum has a dramatic effect on melt flow reduction and cannot be used alone at high levels. For example, aluminum is used to neutralize about 10 percent of the acid groups and sodium is added to neutralize an additional 90 percent of the acid groups.

"Low acid" and "high acid" ionomeric polymers, as well as blends of such ionomers, may be used. In general, low acid ionomers are considered to be those containing 16 weight percent or less of acid moieties, whereas high acid ionomers are considered to be those containing greater than 16 weight percent of acid moieties. In one embodiment, the inner cover layer is formed from a composition comprising a high acid ionomer. A suitable high acid ionomer is Surlyn® 8150 (Dow), which is a copolymer of ethylene and methacrylic acid, having an acid content of 19 weight percent, 45 percent neutralized with sodium. In another embodiment, the inner cover layer is formed from a composition comprising a high acid ionomer and a maleic anhydride-grafted non-ionomeric polymer. An example of a suitable maleic anhydride-grafted polymer is Fusabond® 525D (Dow), which is a maleic anhydride-grafted, metallocene-catalyzed ethylene-butene copolymer having about 0.9 weight percent maleic anhydride grafted onto the copolymer. Blends of high acid ionomers with maleic anhydride-grafted polymers are further disclosed, for example, in U.S. Pat. Nos. 6,992,135 and 6,677,401, the entire disclosures of which are hereby incorporated herein by reference.

When used to form an inner cover layer, the base polymer may include a composition comprising a 50/45/5 blend of Surlyn® 8940/Surlyn® 9650/Nucrel® 960. In this aspect, the composition may have a material hardness of from 80 to 85 Shore C. In another embodiment, the inner cover layer is formed from a composition comprising a 50/25/25 blend of Surlyn® 8940/Surlyn® 9650/Surlyn® 9910, having a material hardness of about 85 to 95 Shore C. In yet another embodiment, the inner cover layer is formed from a composition comprising a 50/50 blend of Surlyn® 8940/Surlyn® 9650, having a material hardness of about 82 to 90 Shore C. A composition comprising a 50/50 blend of Surlyn® 8940 and Surlyn® 7940 also may be used.

The compositions used to make the layers outside of the core, e.g., the outer cover layer and, when present, the inner cover layer, may contain a variety of fillers and additives to impart specific properties to the ball. For example, relatively heavy-weight and light-weight metal fillers such as, particulate; powders; flakes; and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof may be used to adjust the specific gravity of the ball. Other additives and fillers include, but are not limited to, optical brighteners, coloring agents, fluorescent agents, whitening agents, UV absorbers, light stabilizers, surfactants, processing aids, antioxidants, stabilizers, softening agents, fragrance components, plasticizers, impact modifiers, titanium dioxide, clay, mica, talc, glass flakes, milled glass, and mixtures thereof.

Finishing Steps

Golf balls made in accordance with the present disclosure may be subjected to finishing steps such as flash-trimming, surface-treatment, marking, coating, and the like using techniques known in the art. In one embodiment, a white-pigmented cover may be surface-treated using a suitable method such as, for example, corona, plasma, or ultraviolet (UV) light-treatment. Indicia such as trademarks, symbols, logos, letters, and the like may be printed on the cover using pad-printing, ink-jet printing, dye-sublimation, or other suitable printing methods. Clear surface coatings (for example, primer and topcoats), which may contain a fluorescent whitening agent, may be applied to the cover. Golf balls may also be painted with one or more paint coatings in a variety of colors. In one embodiment, white primer paint is applied first to the surface of the ball and then a white top-coat of paint may be applied over the primer.

Golf Ball Construction

Golf balls having various constructions may be made in accordance with the present disclosure. For example, golf balls having one-piece, two-piece, three-piece, four-piece, and five or more piece constructions with the term "piece" referring to any core, cover, or intermediate layer of a golf ball construction. Representative illustrations of such golf ball constructions are provided and discussed further below. The term, "layer" as used herein means generally any spherical portion of the golf ball.

In one embodiment, a golf ball of the present disclosure is a one-piece ball where the core and cover form a single integral layer. In another aspect, shown in FIG. 1A, a golf ball of the present disclosure is a two-piece golf ball 10 comprising a single core layer 12 and a single cover layer 14. In one aspect, the single core layer 12 is formed from metal foam.

Figure 1B:
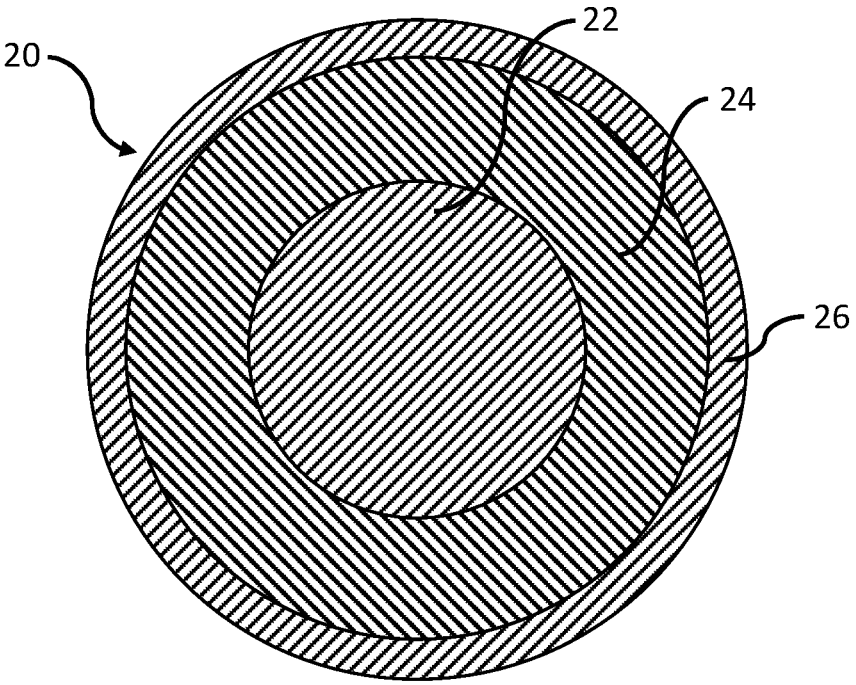
FIG. 1B is a cross-sectional view of a three-piece golf ball in accordance with another example.

As shown in FIG. 1B, in one embodiment, a three-piece golf ball 20 comprises a core layer 22, an intermediate layer 24, and a cover layer 26. In FIG. 1B, the intermediate layer 24 can be considered an outer core layer, an inner cover layer, a mantle or casing layer, or any other layer disposed between the core layer 22 and the cover layer 26. In one aspect, the core layer 22 is formed from metal foam. In one aspect, the intermediate layer 24 is formed from metal foam. In another aspect, the core layer 22 and the intermediate layer 24 are both formed from metal foam. In one aspect, the metal foam used to form the core layer 22 and the intermediate layer 24 are identical; while in another aspect, at least two different metal foams can be used to form the core layer 22 and the intermediate layer 24. In one aspect, metal foam is incorporated into the cover layer 26.

Figure 1C:
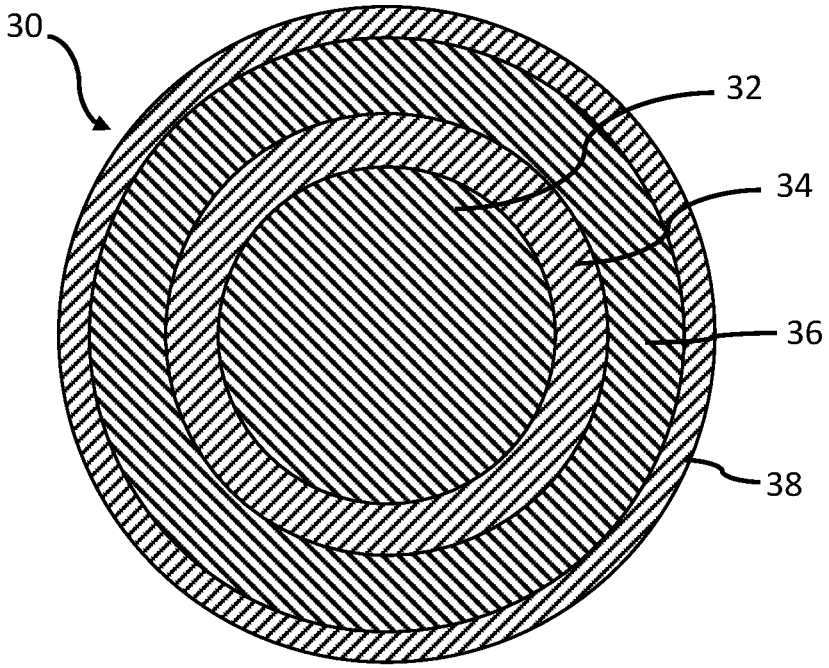
FIG. 1C is a cross-sectional view of a four-piece golf ball in accordance with another example.

Referring to FIG. 1C, in another embodiment, a four-piece golf ball 30 comprises an inner core layer 32, an outer core layer 34, an intermediate layer 36, and an outer cover layer 38. In FIG. 1C, the intermediate layer 36 may be considered a casing or mantle layer, or inner cover layer, or any other layer disposed between the outer core layer 34 and the outer cover layer 38 of the golf ball 30. In one aspect, the inner core layer 32 is formed from metal foam. In one aspect, the outer core layer 34 is formed from metal foam. In one aspect, the intermediate layer 36 is formed from metal foam. In another aspect, at least one of the core layers 32, 34, and the intermediate layer 36 are each formed from metal foam. The inner and outer core layers 32, 34 can both be formed from an identical metal foam, or can be formed from various, different metal foams. Likewise, the intermediate layer 36 can be formed from an identical metal foam as at least one of the core layers 32, 34 or a different metal foam. In one aspect, metal foam is incorporated into the outer cover layer 38.

Figure 1D:
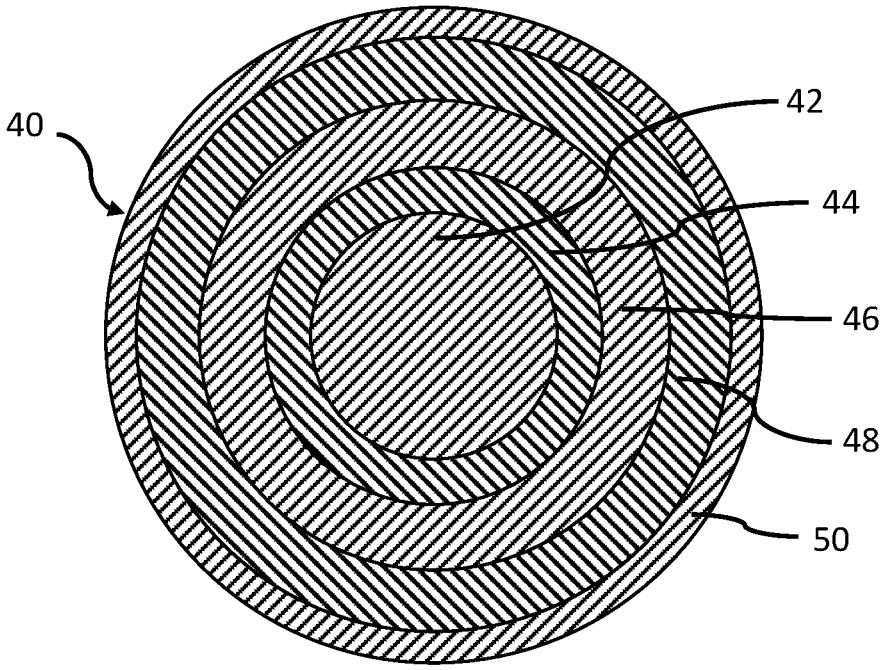
FIG. 1D is a cross-sectional view of a five-piece golf ball in accordance with another example.

Referring to FIG. 1D, in another version, a five-piece golf ball 40 comprises a three-layered core having an inner core layer 42, an intermediate core layer 44, an outer core layer 46, an inner cover layer 48, and an outer cover layer 50. Any one or more of the inner core layer 42, the intermediate core layer 44, the outer core layer 46, and the inner cover layer 48 can be formed from at least one type of metal foam. In one aspect, metal foam is incorporated into the outer cover layer 38.

As exemplified herein, a golf ball in accordance with the present disclosure can comprise any combination of any number of core layers, intermediate layers, and cover layers.

Any one or more of the layers shown in FIGS. 1A-1D, can be formed from metal foam. For example, in one aspect, only the innermost core layer is formed from metal foam, and the remainder of the golf ball layers are formed from materials besides metal foam. In another aspect, an outermost core layer is formed from metal foam. In another aspect, a casing layer or intermediate layer is formed from metal foam. In yet another aspect, multiple golf ball layers are formed from metal foam. In other aspects, multiple layers of the golf ball can be formed from at least two different types of metal foam. In one aspect, the golf ball includes a dual core and the inner core layer is formed from metal foam, the outer core layer is formed from rubber, a casing layer is formed from metal foam, and a cover layer is formed from urethane or ionomer. In one aspect, a first metal foam layer is directly adjacent to a second metal foam layer. In one aspect, a first metal foam layer is spaced apart from a second metal foam layer by at least one intermediate layer. In one aspect, a cover layer, inner cover layer, or outer cover layer is formed from metal foam.

The present disclosure is not meant to be limited by the material used to form each layer of the golf ball. Particularly suitable materials include, but are not limited to, thermosetting materials, such as polybutadiene, styrene butadiene, isoprene, polyisoprene, and trans-isoprene; thermoplastics, such as ionomer resins, polyamides and polyesters; thermoplastic and thermosetting polyurethane and polyureas; and metal foams. In one aspect, at least one layer or component of the golf balls disclosed herein comprises a metal foam feature or component. In one aspect, at least one layer or component of the golf balls disclosed herein is formed entirely from at least one metal foam.

Particularly suitable thermosetting materials, include, but are not limited to, thermosetting rubber compositions comprising a base polymer, an initiator agent, a coagent and/or a curing agent, and optionally one or more of a metal oxide, metal fatty acid or fatty acid, antioxidant, soft and fast agent, fillers, and additives. Suitable base polymers include natural and synthetic rubbers including, but not limited to, polybutadiene, polyisoprene, ethylene propylene rubber ("EPR"), styrene-butadiene rubber, styrenic block copolymer rubbers (such as SI, SIS, SB, SBS, SIBS, and the like, where "S" is styrene, "I" is isobutylene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, acrylonitrile butadiene rubber, polychloroprene, alkyl acrylate rubber, chlorinated isoprene rubber, acrylonitrile chlorinated isoprene rubber, polyalkenamers, and combinations of two or more thereof. Suitable initiator agents include organic peroxides, high energy radiation sources capable of generating free radicals, C-C initiators, and combinations thereof. Suitable coagents include, but are not limited to, metal salts of unsaturated carboxylic acids; unsaturated vinyl compounds and polyfunctional monomers (e.g., trimethylolpropane trimethacrylate); phenylene bismaleimide; and combinations thereof. Suitable curing agents include, but are not limited to, sulfur; N-oxydiethylene 2-benzothiazole sulfenamide; N,N-di-ortho-tolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof. Suitable types and amounts of base polymer, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Patent Application Publication 2007/0093318, the entire disclosure of which is hereby incorporated herein by reference.

Particularly suitable materials also include, but are not limited to: a) thermosetting polyurethanes, polyureas, and hybrids of polyurethane and polyurea; b) thermoplastic polyurethanes, polyureas, and hybrids of polyurethane and polyurea, including, for example, Estane® TPU, commercially available from The Lubrizol Corporation; c) E/X- and E/X/Y-type ionomers, wherein E is an olefin (e.g., ethylene), X is a carboxylic acid (e.g., acrylic, methacrylic, crotonic, maleic, fumaric, or itaconic acid), and Y is a softening comonomer (e.g., vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons), such as Surlyn® ionomer resins and HPF 1000 and HPF 2000, commercially available from The Dow Chemical Company, Iotek® ionomers, commercially available from ExxonMobil Chemical Company, Amplify® IO ionomers of ethylene acrylic acid copolymers, commercially available from The Dow Chemical Company, and Clarix® ionomer resins, commercially available from A. Schulman Inc.; d) polyisoprene; e) polyoctenamer, such as Vestenamer® polyoctenamer, commercially available from Evonik Industries; f) polyethylene, including, for example, low density polyethylene, linear low density polyethylene, and high density polyethylene; polypropylene; g) rubber-toughened olefin polymers; non-ionomeric acid copolymers, e.g., (meth)acrylic acid, which do not become part of an ionomeric copolymer; h) plastomers; i) flexomers; j) styrene/butadiene/styrene block copolymers; k) styrene/ethylene-butylene/styrene block copolymers; l) polybutadiene; m) styrene butadiene rubber; n) ethylene propylene rubber; o) ethylene propylene diene rubber; p) dynamically vulcanized elastomers; q) ethylene vinyl acetates; r) ethylene (meth)acrylates; s) polyvinyl chloride resins; t) polyamides, amide-ester elastomers, and copolymers of ionomer and polyamide, including, for example, Pebax® thermoplastic polyether and polyester amides, commercially available from Arkema Inc; u) crosslinked trans-polyisoprene; v) polyester-based thermoplastic elastomers, such as Hytrel® polyester elastomers, commercially available from E. I. du Pont de Nemours and Company, and Riteflex® polyester elastomers, commercially available from Ticona; w) polyurethane-based thermoplastic elastomers, such as Elastollan® polyurethanes, commercially available from BASF; x) synthetic or natural vulcanized rubber; y) and combinations thereof.

Compositions comprising an ionomer or a blend of two or more E/X- and E/X/Y-type ionomers are particularly suitable intermediate and cover layer materials. Preferred E/X- and E/X/Y-type ionomeric cover compositions include: (a) a composition comprising a "high acid ionomer" (i.e., having an acid content of greater than 16 wt %), such as Surlyn® 8150; (b) a composition comprising a high acid ionomer and a maleic anhydride-grafted non-ionomeric polymer (e.g., Fusabond® functionalized polymers). A particularly preferred blend of high acid ionomer and maleic anhydride-grafted polymer is a 84 wt %/16 wt % blend of Surlyn® 8150 and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference; (c) a composition comprising a 50/45/5 blend of Surlyn® 8940/Surlyn® 9650/Nucrel® 960, preferably having a material hardness of from 80 to 85 Shore C; (d) a composition comprising a 50/25/25 blend of Surlyn® 8940/Surlyn® 9650/Surlyn® 9910, preferably having a material hardness of about 90 Shore C; (e) a composition comprising a 50/50 blend of Surlyn® 8940/Surlyn® 9650, preferably having a material hardness of about 86 Shore C; (f) a composition comprising a blend of Surlyn® 7940/Surlyn® 8940, optionally including a melt flow modifier; (g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9120), optionally including one or more melt flow modifiers such as an ionomer, ethylene-acid copolymer or ester terpolymer; and (h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140 or 8150, 40-50 wt % Surlyn® 9120, and 0-10 wt % Surlyn® 6320).

Surlyn 8150®, Surlyn® 8940, and Surlyn® 8140 are different grades of E/MAA copolymer in which the acid groups have been partially neutralized with sodium ions. Surlyn® 9650, Surlyn® 9910, and Surlyn® 9120 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Surlyn® ionomers, Fusabond® polymers, and Nucrel® copolymers are commercially available from The Dow Chemical Company.

Suitable E/X- and E/X/Y-type ionomeric cover materials are further disclosed, for example, in U.S. Pat. Nos. 6,653,382, 6,756,436, 6,894,098, 6,919,393, and 6,953,820, the entire disclosures of which are hereby incorporated by reference.

Suitable metal foams can include, for example, aluminum, copper, tantalum, tin, titanium, or zinc. One of ordinary skill in the art would understand that metal foams can include various other metals or metallic alloys. In other examples, the metal foam can be formed from any one or more of steel, brass, tungsten, magnesium, molybdenum, cobalt, nickel, iron, lead, barium, bismuth, bronze, silver, gold, and platinum, and alloys and combinations thereof. In one aspect, the metal foam can be a closed-cell foam or an open-cell foam.

In one aspect, the metal foam has a porosity of at least 50%. In another aspect, the metal foam has a porosity of at least 75%. In another aspect, the metal foam has a porosity of at least 95%. In one aspect, the metal foam has a porosity of at least 99.0%. In yet another aspect, the metal foam has a porosity of at least 99.9%.

In one aspect, the metal foam has a specific gravity of no greater than 0.50. In another aspect, the metal foam has a specific gravity of no greater than 0.25. In another aspect, the metal foam has a specific gravity of no greater than 0.10. In another aspect, the metal foam has a specific gravity of no greater than 0.05. In another aspect, the metal foam has a specific gravity of no greater than 0.01. In another aspect, the metal foam has a specific gravity of no greater than 0.005. In another aspect, the metal foam has a specific gravity of no greater than 0.001.

Golf Ball Properties

Hardness

The hardness of the geometric center of the core may be obtained according to the following: the core is first gently pressed into a hemispherical holder having an internal diameter approximately slightly smaller than the diameter of the core, such that the core is held in place in the hemispherical portion of the holder while concurrently leaving the geometric central plane of the center exposed. The core is secured in the holder by friction, such that it will not move during the cutting and grinding steps, but the friction is not so excessive that distortion of the natural shape of the core would result. The core is secured such that the parting line of the center is roughly parallel to the top of the holder. The diameter of the center is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the geometric center of the core is confirmed with a center square and carefully marked, and the hardness is measured at the center mark according to ASTM D-2240.

Additional hardness measurements at any distance from the geometric center of the core can then be made by drawing a line radially outward from the geometric center mark and measuring the hardness at any given distance along the line, typically in 2 mm increments from the center of the core. The hardness at a particular distance from the geometric center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of the core (or any golf ball layer) is measured on the actual outer surface of the layer and is obtained from the average of a number of measurements taken from opposing hemispheres, taking care to avoid making measurements on the parting line of the core or on surface defects, such as holes or protrusions and preferably making the measurements prior to surrounding the layer of interest with an additional layer. Hardness measurements are made pursuant to ASTM D-2240 "Indentation Hardness of Rubber and Plastic by Means of a Durometer." Because of the curved surface, care must be taken to ensure that the golf ball or golf ball sub-assembly is centered under the durometer indenter before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conforms to ASTM D-2240. It is worthwhile to note that, once an additional layer surrounds a layer of interest, the hardness of the layer of interest can be difficult to determine. Therefore, for purposes of the present disclosure, when the hardness of a layer is needed after the inner layer has been surrounded with another layer, the test procedure for measuring a point located 1 mm from an interface is used.

It should also be noted that there is a fundamental difference between "material hardness" and "hardness as measured directly on a golf ball" (or, as used herein, "surface hardness"). For purposes of the present disclosure, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of layers, and the like); golf ball (or golf ball sub-assembly) diameter; and the material composition of adjacent layers. It also should be understood that the two measurement techniques are not linearly related and, therefore, one hardness value cannot easily be correlated to the other. Shore hardness (for example, Shore C or Shore D hardness) was measured according to the test method ASTM D-2240.

A golf ball core made from a rubber and/or metal foam formulation of the present disclosure may have a hardness at the geometric center of the core, referred to herein as HC, that ranges from about 40 to about 90 Shore C. In one embodiment, the core has a hardness at its geometric center of about 45 to about 65 Shore C or about 48 to about 58 Shore C or about 49 to about 52 Shore C. In another embodiment, the core has a hardness at its geometric center of about 55 to about 75 Shore C or about 60 to about 66 Shore C or about 68 to about 74 Shore C. In yet another embodiment, the core has a hardness at its geometric center of about 65 to about 85 Shore C or about 66 to about 74 Shore C or about 77 to about 84 Shore C.

The hardness at the surface of the core, referred to herein as HS, may range from about 60 to about 95 Shore C. In one embodiment, the hardness at the surface of the core is about 70 to about 95 Shore C or about 72 to about 82 Shore C or about 85 to about 95 Shore C or about 87 to about 93 Shore C. In another embodiment, the hardness at the surface of the core is about 65 to about 95 Shore C or about 73 to about 93 Shore C or about 74 to about 84 Shore C. In yet another embodiment, the hardness at the surface of the core is about 72 to about 95 Shore C or about 77 to about 85 Shore C or about 88 to about 94 Shore C. In yet another embodiment, the hardness at the surface of the core is about 60 Shore C to about 120 Shore C.

In one specific aspect, the metal foam forming any one or more layers of the golf ball can be formed from a material having a hardness of 2.5-7.0 on the Mohs scale.

The direction of the hardness gradient is defined by the difference in hardness measurements taken at the geometric center and outer surfaces of the core. The geometric center hardness is readily determined according to the test procedures provided above. For example, the hardness of the outer surface of the core is also readily determined according to the procedures given herein for measuring the outer surface hardness of a golf ball layer, if the measurement is made prior to surrounding the core with additional layers.

While the hardness gradient across the core will vary based on several factors including, but not limited to, the dimensions and formulations of the components, the core of the present disclosure has a "positive" hardness gradient (that is, the geometric center is softer than the outer surface of the core). More particularly, the term, "positive hardness gradient" as used herein means a hardness gradient of positive about 2 Shore C or greater, about 4 Shore C or greater, about 6 Shore C or greater, about 8 Shore C or greater, or about 10 Shore C or greater. In general, the hardness gradient may be determined by subtracting the hardness value of one component being measured (for example, the geometric center of the core, HC) from the hardness value of another component being measured (for example, the outer surface of the core, HS).

The core of the present disclosure can have a positive hardness gradient, in one aspect. In one embodiment, the core has a positive hardness gradient from the geometric center to the surface of the core of about 2 Shore C to 42 Shore C. In this aspect, the positive hardness gradient of the core is about 5 Shore C to about 40 Shore C. The rubber formulation of the core may be tailored to produce a desired hardness gradient in the core. In some embodiments, the positive hardness gradient of the core is about 30 to about 42 Shore C or about 34 Shore C to 41 Shore C or about 37 Shore C to about 40 Shore C. In other embodiments, the positive hardness gradient of the core is about 3 Shore C to about 25 Shore C or about 10 Shore C to about 23 Shore C, or about 11 Shore C to about 17 Shore C. In further embodiments, the positive hardness gradient of the core may be about 2 Shore C to about 40 Shore C or about 7 Shore C to about 12 Shore C or about 8 Shore C to 11 Shore C. In yet further embodiments, the positive hardness gradient of the core may be about 1 Shore C to about 40 Shore C.

The hardness of the core may not increase linearly from the center of the core to the outer surface of the core. For example, one or more regions within the core may have a "zero" hardness gradient, i.e., the hardness values across the region are substantially the same. The term, "zero hardness gradient" as used herein means a hardness gradient of-2 Shore C to 2 Shore C, preferably between about −1 Shore C and about 1 Shore C and may have a value of zero. In some embodiments, one or more regions of the core may also have a "negative" hardness gradient, i.e., the hardness values across the region may decrease from the inner edge of the region to the outer edge of the region.

For example, the core, or a layer of the core if the core has multiple layers, may be characterized by three regions: an inner region, an intermediate region, and an outer region. Each of the inner region, intermediate region, and outer region may have its own hardness gradient. For a single-layer core, the inner region is the region of the core surrounding the center of the core and is characterized by positive hardness gradient of about 2 Shore C to about 25 Shore C. In some embodiments, the positive hardness gradient of the inner region of the core is about 6 Shore C to about 25 Shore C or about 16 Shore C to about 23 Shore C. In other embodiments, the positive hardness gradient of the inner region of the core is about 1 Shore C to about 13 Shore C or about 6 Shore C to about 11 Shore C. In further embodiments, the positive hardness gradient of the inner region of the core is about 5 Shore C to about 9 Shore C or about 6 Shore C to about 8 Shore C.

The outer region of the core is the region of the core adjacent the surface of the core and may be characterized by a zero or positive hardness gradient from about −2 Shore C to about 28 Shore C. In some embodiments, the outer region may have a positive hardness gradient from 2 Shore C to about 27 Shore C or about 16 Shore C to about 27 Shore C or about 17 Shore C to about 22 Shore C. In other embodiments, the outer region may have a zero or positive hardness gradient from −2 Shore C to about 16 Shore C or about 2 Shore C to about 6 Shore C or about 10 Shore C to about 15 Shore C. In further embodiments, the outer region may have a zero or positive hardness gradient from −2 Shore C to about 14 Shore C or about 1 Shore C to about 8 Shore C or about 2 Shore C to about 6 Shore C.

The intermediate region of the core is the region of the core between the inner region and the outer region and may be characterized by a negative, zero, or positive hardness gradient from about −10 to 8 Shore C. In some embodiments, the intermediate region may have a negative, zero, or positive hardness gradient from −7 to about 6 Shore C or about −6 to about 1 Shore C. In other embodiments, the intermediate region may have a positive hardness gradient from −7 to about 4 Shore C or about −2 to about 4 Shore C. In further embodiments, the intermediate region may have a negative or zero hardness gradient from −10 to about 0 Shore C or about −4 Shore C to about 0 Shore C.

In some embodiments, a point or plurality of points measured along a "positive" gradient may be above or below a line fit through the gradient and its outermost and innermost hardness values. In an alternative embodiment, the hardest point along a particular steep "positive" gradient may be higher than the value at the innermost portion of the center (the geometric center) or outer surface of the core—as long as the outermost point (i.e., the outer surface of the core) is greater than the innermost point (i.e., the geometric center of the core), such that the "positive" gradients remain intact. In one aspect, the golf ball core is formed from metal foam and can have a zero hardness gradient. In one aspect, the golf ball core is formed from metal foam and can have a positive hardness gradient. In one aspect, the golf ball core is formed from metal foam and can have a negative hardness gradient.

Compression

Several different methods can be used to measure compression, including Atti compression, Riehle compression, load/deflection measurements at a variety of fixed loads and offsets, and effective modulus (see, e.g., Compression by Any Other Name, Science and Golf IV, Proceedings of the World Scientific Congress of Golf (Eric Thain ed., Routledge, 2002) (J. Dalton)). For purposes of the present disclosure, compression values are provided as measured by the Dynamic Compression Machine ("DCM") as well as the Soft Center Deflection Index ("SCDI"). The DCM applies a load to a ball component or a ball and measures the number of inches the core or ball is deflected at measured loads. A crude load/deflection curve is generated that is fit to the Atti compression scale that results in a number being generated that represents an Atti compression. The DCM does this via a load cell attached to the bottom of a hydraulic cylinder that is triggered pneumatically at a fixed rate (typically about 1.0 ft/s) towards a stationary core. Attached to the cylinder is an LVDT that measures the distance the cylinder travels during the testing timeframe. A software-based logarithmic algorithm ensures that measurements are not taken until at least five successive increases in load are detected during the initial phase of the test.

The SCDI is a slight variation of the DCM set up that allows determination of the pounds required to deflect a component or ball 10 percent of its diameter. With the SCDI, the goal is to obtain the pounds of force required to deflect a component or ball a certain number of inches. That amount of deflection is 10 percent of the component or ball diameter. The DCM is triggered, the cylinder deflects the component or ball by 10 percent of its diameter, and the DCM reports back the pounds of force required (as measured from the attached load cell) to deflect the component or ball by that amount. The SCDI value obtained is a single number in units of pounds.

The compression of a core made from the rubber formulation of the present disclosure may range from about 20 to about 120 DCM or more preferably about 50 to about 120 DCM. For example, the core compression may be about 50 to about 85 DCM or about 60 to 80 DCM or about 65 to about 75 DCM. In another example, the core compression may range from about 50 to about 100 DCM or about 55 to about 65 DCM or about 80 to 100 DCM. In another example, the core compression may range from about 50 DCM to about 95 DCM. In yet another example, the core compression is about 60 to about 120 DCM or about 110 to about 120 DCM or about 60 to about 80 DCM or about 71 to about 79 DCM. In some embodiments, it may be desirable for a core comprising the rubber formulation of the present disclosure to have a compression from about 68 to about 75 DCM or from about 70 to about 74 DCM regardless of the hardening agent used.

In one specific aspect in which the core is formed from metal foam, the core can have a negative compression. In one aspect, the compression of the core including metal foam can be-215 DCM to 120 DCM. In another aspect, the compression of the core can be no greater than −200 DCM. In another aspect, the compression of the core can be no greater than 0 DCM. In one aspect, a metal foam center could have a compression of 60 SCDI-140 SCDI. In one aspect, a dual core including a metal foam in either layer could have a compression of 60 DCM-120 DCM. In another aspect, a cased core including a solid or dual core comprising metal foam in at least one layer could have a compression of 60 DCM-120 DCM. In another aspect, a finished golf ball of any number of layers including a metal foam feature could have a compression of 65 DCM-120 DCM.

Diameter

The diameter of the core or core layer(s), intermediate layer(s), and cover layer(s) may vary. In some embodiments, the core diameter may range from about 1.50 to about 1.58 inches. For example, the core may have a diameter of 1.53 to 1.56 inches. In some embodiments, the core diameter may range from about 1.20 to about 1.60 inches. In some embodiments, the core diameter may range from about 1.45 to about 1.62 inches. In some embodiments, the core diameter may range from about 1.50 to about 1.60 inches. In embodiments where the core comprises two or more layers, the diameter of the inner layer of the core may range from about 1.0 to about 1.4 inches or from about 1.0 to about 1.2 inches. In further embodiments where the core comprises two or more layers, the diameter of the inner layer of the core may range from about 1.0 to about 1.5 inches, or from about 1.1 to about 1.4 inches, or from about 1.30 to about 1.55 inches.

The at least one layer formed from metal foam can have a diameter of 0.25 inches-1.60 inches, in one example. In another example, the layer formed from metal foam can have a diameter of 0.10 inches-0.50 inches. In another example, the layer formed from metal foam can have a diameter of 0.10 inches-1.620 inches.

Coefficient of Restitution

The golf ball cores of the present disclosure can be tailored to have a desired or targeted coefficient of restitution (CoR) value. In one example, it may be desirable to have a golf ball core with a relatively high CoR value. In one example, the CoR of the golf ball cores formed according to the present disclosure at 125 ft/s is about 0.740 or greater. In another example, the CoR of the golf ball core according to the present disclosure at 125 ft/s is about 0.860 or greater. In another example, the CoR of the golf ball core according to the present disclosure at 125 ft/s is about 0.820 or greater. One of ordinary skill in the art would understand based on the present disclosure that these CoR values can vary.

In one specific aspect in which the core is formed from metal foam, the core can have a CoR of 0.850 (+/−0.050). In one specific aspect in which the inner core layer is formed from metal foam, the inner core layer can have a CoR of 0.800 (+/−0.050). In one specific aspect in which the outer core layer is formed from metal foam, the outer core layer can have a CoR of 0.750 (+/−0.050). In one specific aspect in which the casing layer is formed from metal foam, the casing layer can have a CoR of 0.820 (+/−0.050). In one aspect, a golf ball including at least one layer formed from metal foam can have an overall CoR of 0.830 (+/−0.050). One of ordinary skill in the art would understand that these values can vary depending on various factors throughout the remainder of the golf ball construction.

EXAMPLES

Compositions for various golf balls and/or golf ball cores are disclosed herein. The golf balls can include metal foam in at least one layer.

In a first example, a golf ball is provided that includes a core, a casing layer, and a cover layer. The core is formed from a metal foam. The casing layer is formed from an ionomer or other suitable material. The cover layer is formed from a urethane, ionomer, or other suitable material.

In a second example, a golf ball is provided that includes a dual layer core, a casing layer, and a cover layer. The inner layer of the core is formed from a metal foam. The outer layer of the core is formed from a rubber composition. The casing layer is formed from an ionomer or other suitable material. The cover layer is formed from a urethane, ionomer, or other suitable material.

In a third example, a golf ball is provided that includes a dual layer core, a casing layer, and a cover layer. The outer layer of the core is formed from a metal foam. The inner layer of the core is formed from a rubber composition. The casing layer is formed from an ionomer or other suitable material. The cover layer is formed from a urethane, ionomer, or other suitable material.

In a fourth example, a golf ball is provided that includes a core, a casing layer, and a cover layer. The core is formed from rubber. The casing layer is formed from metal foam. The cover layer is formed from a urethane, ionomer, or other suitable material.

In a fifth example, a golf ball is provided that includes a core and a cover layer. The core is formed from metal foam. The cover layer is formed from a urethane, ionomer, or other suitable material.

In any one or more of the examples described herein, the metal foam can be formed from aluminum, copper, tantalum, tin, titanium, or zinc. One of ordinary skill in the art would understand that other materials can be used to form the metal foam layer.

In any one or more of the examples described herein, the metal foam can have a specific gravity of no greater than 0.25. In another example, the specific gravity of the metal foam is no greater than 0.10. In another example, the specific gravity of the metal foam is no greater than 0.05. The specific gravity of the metal foam can be no greater than 0.01, in another example. The specific gravity of the metal foam can be no greater than 0.001, in another example.

The density of the metal foam can be less than 5.0 $mg/cm^3$, in one example. The density of the metal foam can be less than 7.5 $mg/cm^3$, in one example. In another example, the density of the metal foam is less than 10.0 $mg/cm^3$. In another example, the density of the metal foam is less than 25.0 $mg/cm^3$. In another example, the density of the metal foam is less than 50.0 $mg/cm^3$. In another example, the density of the metal foam is less than 100.0 $mg/cm^3$. In another example, the density of the metal foam is less than 1.0 $g/cm^3$. One of ordinary skill in the art would understand that the density of the metal foam can vary.

In one aspect, the metal foam can have a porosity of at least 50.0%. In another aspect, the metal foam can have a porosity of at least 75.0%. In yet another aspect, the metal foam can have a porosity of 70.0%-99.9%. One of ordinary skill in the art would understand that the porosity can vary.

In one aspect, the core is formed from metal foam and lacks any rubber. In another aspect, the casing or mantle layer is formed from metal foam and lacks any ionomer or other materials. The relevant golf ball layer or components disclosed herein can consist essentially of metal foam. In one aspect, the relevant golf ball layer or components disclosed herein consists only of metal foam.

In one aspect, the layer including the metal foam has an outer diameter of 0.25 inches-1.60 inches. In one aspect, the layer including the metal foam has an outer diameter of 0.10 inches-1.68 inches. In one aspect, the layer including the metal foam has an outer diameter of no greater than 1.0 inch. In one aspect, the layer including the metal foam has an outer diameter of no greater than 1.2 inches. In one aspect, the layer including the metal foam has an outer diameter of no greater than 1.60 inches.

In one aspect, the golf ball further comprises at least one second layer that is disposed radially outward from the at least one first layer, and the at least one second layer has a second specific gravity (SG2). In one aspect, the second layer is directly adjacent to the first layer. In another aspect, the second layer is spaced apart from the first layer by at least one additional layer. In yet another aspect, the first layer can be located radially outward from the second layer. A density layer gradient ratio (DLGR) defined by a ratio of the first specific gravity (SG1) to the second specific gravity (SG2) can be no greater than 0.05, in one example. In another example, the density layer gradient ratio (DLGR) is no greater than 0.005. In another example, the density layer gradient ratio (DLGR) is no greater than 0.001. In another example, the density layer gradient ratio (DLGR) is no greater than 0.025. In another example, the density layer gradient ratio (DLGR) is no greater than 0.10. In another example, the density layer gradient ratio (DLGR) is no greater than 0.30.

In one aspect, the specific gravity of the first layer (including the metal foam) can be no greater than 0.20, or no greater than 0.10, or no greater than 0.05, or no greater than 0.005. In one aspect, the specific gravity of the second layer can be 0.80-1.20. In one aspect, the specific gravity of the second layer can be at least 0.95. In one aspect, the specific gravity of the second layer can be no greater than 1.05.

In one example, the at least one first layer (including the metal foam) is formed from a material having a first tensile strength (TS1), and the at least one second layer is formed from a material having a second tensile strength (TS2), such that the golf ball has a strength gradient ratio (SGR) defined by a ratio of the first tensile strength (TS1) to the second tensile strength (TS2), and the strength gradient ratio (SGR) is at least 2.0. In another example, the strength gradient ratio (SGR) is at least 7.5. In another example, the strength gradient ratio (SGR) is at least 10.0. In another example, the strength gradient ratio (SGR) is at least 20.0. In another example, the strength gradient ratio (SGR) is at least 50.0.

In one aspect, the tensile strength of the material forming the first layer (including the metal foam) can be 50.0 MPa-100.0 MPa. In one aspect, the tensile strength of the material forming the first layer can be at least 70.0 MPa. In one aspect, the tensile strength of the material forming the first layer can be at least 90.0 MPa. In one aspect, the tensile strength of the material forming the second layer (which can be an ionomer composition if the second layer is a casing layer in one example) can be 1.0 MPa-25.0 MPa. In one aspect, the tensile strength of the material forming the second layer can be 10.0 MPa-20.0 MPa. In one aspect, the tensile strength of the material forming the second layer can be less than 30.0 MPa.

In one example, a ratio of the strength gradient ratio (SGR) to the density layer gradient ratio (DLGR) is at least 100. In another example, the ratio of the strength gradient ratio (SGR) to the density layer gradient ratio (DLGR) is at least 500. In another example, the ratio of the strength gradient ratio (SGR) to the density layer gradient ratio (DLGR) is at least 1,000. In another example, the ratio of the strength gradient ratio (SGR) to the density layer gradient ratio (DLGR) is at least 2,000.

The at least one first layer formed from metal foam can have a hardness gradient defined between its center and its radially outer surface, and the hardness gradient can be less than 0.1. The hardness gradient of the layer including the metal foam can be zero, in one example.

In one aspect, the golf ball includes a core formed from metal foam, and further comprises a casing, and a cover. In one aspect, mass distribution of the golf ball is concentrated in the non-core layers. For example, at least 95% of the mass of the golf ball can be concentrated in the casing and the cover, while 5% or less of the mass of the golf ball can be concentrated in the core formed from metal foam. In another example, at least 99% of the mass of the golf ball can be concentrated in the casing and the cover, while 1% or less of the mass of the golf ball can be concentrated in the core formed from metal foam. In another example, at least 70% of the mass of the golf ball can be concentrated in the casing and the cover, while 30% or less of the mass of the golf ball can be concentrated in the core formed from metal foam. In another example, at least 80% of the mass of the golf ball can be concentrated in the casing and the cover, while 20% or less of the mass of the golf ball can be concentrated in the core formed from metal foam.

In another exemplary construction, the golf ball can include a dual core with an inner core layer formed from metal foam and an outer core layer formed from rubber, as well as a casing and a cover. In one example, at least 95% of the mass of the golf ball can be concentrated in the outer core layer, casing and the cover, while 5% or less of the mass of the golf ball can be concentrated in the inner core layer formed from metal foam. In another example, at least 99% of the mass of the golf ball can be concentrated in the outer core layer, casing, and the cover, while 1% or less of the mass of the golf ball can be concentrated in the inner core layer formed from metal foam. In another example, at least 90% of the mass of the golf ball can be concentrated in the outer core layer, casing, and the cover, while 10% or less of the mass of the golf ball can be concentrated in the inner core layer formed from metal foam. In another example, at least 75% of the mass of the golf ball can be concentrated in the outer core layer, casing, and the cover, while 25% or less of the mass of the golf ball can be concentrated in the inner core layer formed from metal foam.

In another exemplary construction, the golf ball can include a dual core with an inner core layer formed from rubber and an outer core layer formed from metal foam, as well as a casing and a cover. In one example, at least 95% of the mass of the golf ball can be concentrated in the inner core layer, casing and the cover, while 5% or less of the mass of the golf ball can be concentrated in the outer core layer formed from metal foam. In another example, at least 99% of the mass of the golf ball can be concentrated in the inner core layer, casing, and the cover, while 1% or less of the mass of the golf ball can be concentrated in the outer core layer formed from metal foam. In another example, at least 85% of the mass of the golf ball can be concentrated in the inner core layer, casing, and the cover, while 15% or less of the mass of the golf ball can be concentrated in the outer core layer formed from metal foam. In another example, at least 90% of the mass of the golf ball can be concentrated in the inner core layer, casing, and the cover, while 10% or less of the mass of the golf ball can be concentrated in the outer core layer formed from metal foam.

In one aspect, the layer formed from the metal foam can have a first mass, and a remainder of the golf ball (i.e., all other layers of the golf ball) can have a second mass, and a mass layer gradient ratio (MLGR) of the first mass to the second mass can be no greater than 0.10. In another aspect, the mass layer gradient ratio (MLGR) can be no greater than 0.05. In another aspect, the mass layer gradient ratio (MLGR) can be no greater than 0.01. In another aspect, the mass gradient layer ratio can be no greater than 0.005. In one aspect, the second mass can include the mass of the casing and cover. In another aspect, the second mass can include the mass of a core layer (such as an inner or outer core layer), casing, and cover. In another aspect, the second mass can include the mass of the core and cover, while the first mass can include the mass of the casing.

In one aspect, the golf ball can have the following relationship between the mass layer gradient ratio (MLGR), the density layer gradient ratio (DLGR), and the strength gradient ratio (SGR):

$$\frac{SGR}{MLGR \times DLGR} \geq 100.$$

In another aspect, the golf ball can have the following relationship between the mass layer gradient ratio (MLGR), the density layer gradient ratio (DLGR), and the strength gradient ratio (SGR):

$$\frac{SGR}{MLGR \times DLGR} \geq 500.$$

In another aspect, the golf ball can have the following relationship between the mass layer gradient ratio (MLGR), the density layer gradient ratio (DLGR), and the strength gradient ratio (SGR):

$$\frac{SGR}{MLGR \times DLGR} \geq 1{,}000.$$

In one aspect, the present application provides a golf ball having at least one layer formed from metal foam, thereby providing a golf ball having a layer that is lightweight while also having a high strength-to-weight ratio, customizable strength, and high resistance to temperature and pressure.

In one aspect, the resistance to temperature variations can provide improved playability regardless of weather, and in particular provide consistent performance in extreme hot and cold playing locations.

In one aspect, the metal foams can be optimized to accommodate a wide range of golfers, such as lower swing speed golfers and higher swing speed golfers via the selection of particular metals and/or metal alloys.

The metal foam layer of the golf ball can have a zero hardness gradient and does not require compression molding. In one aspect, elimination of compression molding provides manufacturing efficiencies due to the elimination of the requisite high heat/pressure, expensive mold tooling, molding time requirements, etc.

By providing a relatively lower specific gravity via a golf ball core formed from metal foam, the golf ball can exhibit a relatively lower spin rate for long or driver shots because the golf ball's mass is generally distributed in outer layers of the golf ball and away from the metal foam core. In one aspect, the present golf ball can include at least one layer formed from metal foam, which generally provides a reduction in CoR and thereby reduces the distance that the golf ball will travel when struck.

The Royal and Ancient Golf Club of St. Andrews, Scotland (R&A Rules Limited) and United States Golf Association (USGA) set standards for the weight, size, and other properties of golf balls. Manufacturers submit samples of golf balls to the R&A and USGA testing laboratories for a "conformance ruling." Accordingly, the R&A and USGA test the balls to determine whether the balls are "conforming" or "non-conforming."

In order to be in conformance, the golf ball must have a weight no greater than 1.620 ounces as measured per Test Method for Weight of Ball; a size of at least 1.680 inches as measured per Test Method for Size of Ball; spherical symmetry as measured per Test Method for Spherical Symmetry of Ball; an initial velocity of no greater than 255 feet/second as measured per Test Method for Initial Velocity of Ball; and/or an overall distance of no greater than 320 yards as measured per Test Method for Overall Distance of Ball. Additional details regarding these tests are disclosed in U.S. Pat. No. 11,344,771, which is incorporated by reference as if fully set forth herein and is commonly assigned to Acushnet Company.

In one aspect, the metal foam layer of the golf ball can result in a golf ball with an overall mass that is much less than 1.620 ounces. In another aspect, the golf ball can include fillers or other mass augmenting features to accommodate for the reduced mass of the metal foam layer. In another aspect, a non-conforming golf ball can include a rubber core (having a typical density or heavier density), and a metal foam layer that surrounds the core.

In one aspect, the golf ball disclosed herein can have an initial velocity of 200 feet/second-225 feet/second per the Test Method for Initial Velocity of Ball. In one aspect, the golf ball disclosed herein can have an initial velocity of 200 feet/second-250 feet/second per the Test Method for Initial Velocity of Ball. In one aspect, the golf ball disclosed herein can have an initial velocity of less than 245 feet/second per the Test Method for Initial Velocity of Ball. In another aspect, the golf ball including a metal foam layer can have an initial velocity that is greater than 255 feet/second.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety.

What is claimed is:

1. A golf ball comprising:

at least one first layer comprised of at least one metal foam having a first specific gravity of no greater than 0.25, and at least one second layer that is disposed radially outward from the at least one first layer comprised of the at least one metal foam, wherein the at least one second layer has a second specific gravity, and a density layer gradient ratio is defined by a ratio of the first specific gravity to the second specific gravity, and the density layer gradient ratio is no greater than 0.30.

2. The golf ball according to claim 1, wherein the first specific gravity of the at least one metal foam is no greater than 0.10.

3. The golf ball according to claim 1, wherein the first specific gravity of the at least one metal foam is no greater than 0.01.

4. The golf ball according to claim 1, wherein the at least one metal foam is formed from at least one of aluminum, copper, tantalum, tin, titanium, or zinc.

5. The golf ball according to claim 1, wherein the at least one metal foam is formed from aluminum.

6. The golf ball according to claim 1, wherein the at least one metal foam has a porosity of at least 70.0%.

7. The golf ball according to claim 1, wherein the golf ball is comprised of a core, an intermediate layer, and a cover, and the at least one first layer comprised of the at least one metal foam is the intermediate layer.

8. The golf ball according to claim 1, wherein the golf ball is comprised of a core, an intermediate layer, and a cover, and the at least one first layer comprised of the at least one metal foam is the core.

9. The golf ball according to claim 8, wherein the core lacks any rubber.

10. The golf ball according to claim 1, wherein the golf ball is comprised of an inner core, an outer core, an intermediate layer, and a cover, and the at least one first layer comprised of the at least one metal foam is the outer core.

11. The golf ball according to claim 1, wherein the at least one first layer comprised of the at least one metal foam has an outer diameter of 0.25 inches-1.60 inches.

12. The golf ball according to claim 1, wherein the density layer gradient ratio is no greater than 0.05.

13. The golf ball according to claim 1, wherein the at least one metal foam of the at least one first layer has a first tensile strength, and the at least one second layer is formed from a material having a second tensile strength, wherein the golf ball has a strength gradient ratio defined by a ratio of the first tensile strength to the second tensile strength, and a ratio of the strength gradient ratio to the density layer gradient ratio is at least 100.

14. The golf ball according to claim 13, wherein the ratio of the strength gradient ratio to the density layer gradient ratio is at least 1,000, wherein the at least one first layer has a hardness gradient defined between its center and its radially outer surface, and wherein the hardness gradient ratio is less than 0.1, and wherein the at least one first layer has a first mass, and a remainder of the golf ball has a second mass, and a mass layer gradient ratio of the first mass to the second mass is no greater than 0.10.

15. A golf ball comprising:

at least one first layer comprised of at least one metal foam having a first specific gravity of no greater than 0.25, and at least one second layer that is disposed radially outward from the at least one first layer comprised of the at least one metal foam, wherein the at least one metal foam of the at least one first layer has a first tensile strength, and the at least one second layer is formed from a material having a second tensile strength, wherein the golf ball has a strength gradient ratio defined by a ratio of the first tensile strength to the second tensile strength, and the strength gradient ratio is at least 2.0.

16. A golf ball comprising:

a core layer comprised of at least one metal foam having a first specific gravity of no greater than 0.25, wherein the at least one metal foam is formed from at least one of aluminum, copper, tantalum, tin, titanium, or zinc, wherein the core lacks any rubber, and wherein the at least one metal foam has a porosity of at least 70.0%, and at least one second layer that is disposed radially outward from the core layer, wherein the at least one second layer has a second specific gravity, and a density layer gradient ratio is defined by a ratio of the first specific gravity to the second specific gravity, and the density layer gradient ratio is no greater than 0.30.

17. The golf ball according to claim 16, wherein the at least one metal foam of the core layer has a first tensile strength, and the at least one second layer is formed from a material having a second tensile strength, wherein the golf ball has a strength gradient ratio defined by a ratio of the first tensile strength to the second tensile strength, and the strength gradient ratio is at least 2.0.

* * * * *